United States Patent [19]

Keilhau

[11] Patent Number: 4,693,475

[45] Date of Patent: Sep. 15, 1987

[54] RACKET HAVING ROTATABLY ADJUSTABLE HANDLE

[76] Inventor: Karl F. Keilhau, Tackheide 96/98, 4150 Krefeld, Fed. Rep. of Germany

[21] Appl. No.: 774,854

[22] Filed: Sep. 10, 1985

Related U.S. Application Data

[63] Continuation-in-part of Ser. No. 678,702, Dec. 6, 1984, abandoned.

[30] Foreign Application Priority Data

Dec. 8, 1983 [DE] Fed. Rep. of Germany ..... 3344329

[51] Int. Cl.[4] ..... A63B 49/08

[52] U.S. Cl. ..... 273/73 J; 273/81 C

[58] Field of Search ..... 273/73 J, 75, 73 E, 273/81.2, 81 C, 72 A, 72 R, 79; 220/288; 403/21, 259, 362; 74/551.9; 16/110 R, DIG. 24; 81/177.8

[56] References Cited

U.S. PATENT DOCUMENTS

| | | | |
|---|---|---|---|
| 137,674 | 4/1873 | Goodsell | 403/362 X |
| 1,912,942 | 6/1933 | Kleinman | 273/73 E |
| 1,937,787 | 12/1933 | Robinson | 273/73 H |
| 2,550,295 | 4/1951 | Price | 273/81 C |
| 3,534,960 | 10/1970 | Hanks | 273/75 |
| 3,545,755 | 12/1970 | Iwada | 273/75 |
| 4,033,583 | 7/1977 | Ehrhart | 273/73 J |
| 4,101,125 | 7/1978 | Heath | 273/75 |

FOREIGN PATENT DOCUMENTS

| | | | |
|---|---|---|---|
| 401557 | 3/1934 | Belgium . | |
| 1112435 | 8/1961 | Fed. Rep. of Germany | 273/73 J |
| 2458572 | 6/1976 | Fed. Rep. of Germany . | |
| 2458581 | 6/1976 | Fed. Rep. of Germany . | |
| 7717463 | 6/1977 | Fed. Rep. of Germany . | |
| 470891 | 4/1969 | Switzerland . | |
| 808614 | 2/1959 | United Kingdom | 273/73 J |
| 2149311 | 6/1985 | United Kingdom | 273/73 J |

*Primary Examiner*—Richard C. Pinkham
*Assistant Examiner*—Matthew L. Schneider
*Attorney, Agent, or Firm*—W. G. Fasse; D. H. Kane, Jr.

[57] ABSTRACT

A racket for ball games and more specifically, a tennis racket, has a frame forming a racket head, a shank and a grip secured to the shank with a force fit so that the grip may be turned in relation to the racket head into different settings. The force fit connecting elements are simple to manufacture, yet permit an exact stepless setting and a satisfactory transmission of the forces produced while still avoiding a slip clutch effect. The grip and the racket shank are joined with each other by a surface area of substantial size which assures the required frictional engagement for the force fit in the angular direction while providing a form locking connection in the axial direction. The shank is part of an integral, one-piece handle bar which also has a cylindrical section and a conical section integrally interconnecting the shank to the cylindrical section.

7 Claims, 6 Drawing Figures

RACKET HAVING ROTATABLY ADJUSTABLE HANDLE

CROSS-REFERENCE TO RELATED APPLICATION

The present application is a continuation-in-part application of my copending application U.S. Ser. No.: 678,702; filed on Dec. 6, 1984; and entitled: "A RACKET FOR BALL GAMES". The parent application has become abandoned.

FIELD OF THE INVENTION

The present invention relates to rackets for ball games, more specifically to a tennis racket including a racket frame with a head part, a shank and a grip that may be adjusted in relation to the racket head.

DESCRIPTION OF THE PRIOR ART

A tennis racket of this type has been disclosed in the German Utility Model No.: 7,717,463, in which the handle has a plurality of spline grooves and the shank end fitting into the handle has a plurality of splines fitting into any one of said spline grooves to provide a toothed connection, whereby the handle may be adjusted in steps in its angular position around the longitudinal shank axis and the racket may be used with different angular settings. This is convenient, especially for playing backhand strokes. However, this known racket construction has not been widely accepted because the adjustment is slow to undertake and is only possible in steps, so that it provides only a limited number of angular settings. Furthermore, after the racket has been used for a long time, the teeth of the connection wear and the handle parts become loose. Additionally, the manufacture of the spline grooves inside the handle and the teeth or splines on the shank end is expensive.

U.S. Pat. No. 3,545,755 (Owada) discloses a tennis racket having a rigid handle that is turned in relation to the ball striking plane defined by the head part. However, this tennis racket has again not become accepted for general use.

U.S. Pat. No. 4,033,583 (Ehrhart) discloses a tennis racket with a slip clutch between the handle and the shank. The slip clutch permits the racket head to rotate relative to the handle to reduce the transmission of shock forces from the head to the arm of the user for avoiding or lessening the occurrence of so-called tennis elbow. The clutch transmits lower forces up to a certain level and slips in response to forces above the level which may be adjustable. This type of structure does not permit the stepless adjustment of a fixed angular position of the handle relative to the plane of the racket head.

It is also known to connect the handles to a curling iron in such a way that loosening a nut or screw will permit rotation of a handle sleeve relative to the tool, if desired as disclosed in U.S. Pat. No. 2,550,295 (Price). British Pat. No. 808,614 (Brookes) discloses a chisel or screw driver with a fixed handle connection not intended for any angular position adjustments. There is room for improvement with regard to the force locking features.

OBJECTS OF THE INVENTION

In view of the above it is the aim of the invention to achieve the following objects singly or in combination:

to construct a racket for a ball game, specifically a tennis racket, in such a way that the grip may be adjusted in a continuous, stepless manner when a nut is loosened and fixed in any adjusted position in relation to the head of the racket when the nut is tightened;

to construct the racket, especially its grip connecting elements so that the racket may be produced economically at a favorable price;

to provide a handle adjustment mechanism for a ball racket which provides a force locking, exclusively frictional connection between the grip and the shank in the direction around the longitudinal shank axis, and a form locking connection in the axial direction; and to construct the grip adjustment mechanism as simple as possible, yet permitting the desired adjustment in an easy manner.

SUMMARY OF THE INVENTION

These and other objects have been achieved by a racket in which the grip is secured to the handle bar of the racket by a force locking, frictional connection, whereby the angular setting of the grip relative to the plane defined by the head of the racket around the longitudinal axis of the handle bar and grip is normally fixed without any slip clutch effect. In the axial direction the connection provides a form locking load transmission. A frictional or force locking connection allows a steplessly fine adjustment of the grip relative to the head of the racket when the force locking is released because only smooth contact faces are involved in the frictional connection.

A conical member on the handle bar forms a transition between the shank of the handle bar and a bolt section provided with a threading at the free end of the bolt section. The grip has a conical hollow, internal conical recess facing toward the head of the racket and merging into a cylindrical bore through the grip. The threaded bolt section passes through the cylindrical bore, preferably with a tight fit, and a threaded member, such as a wing-type nut, engaging the threaded bolt, rests against the grip end. This combination of features makes possible a satisfactory transmission of the transverse forces acting in the shank or grip of the racket when the threaded member is tightened and in the loosened condition these features enable a stepless, fine adjustment of the angular relationship between the head of the racket and the grip.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
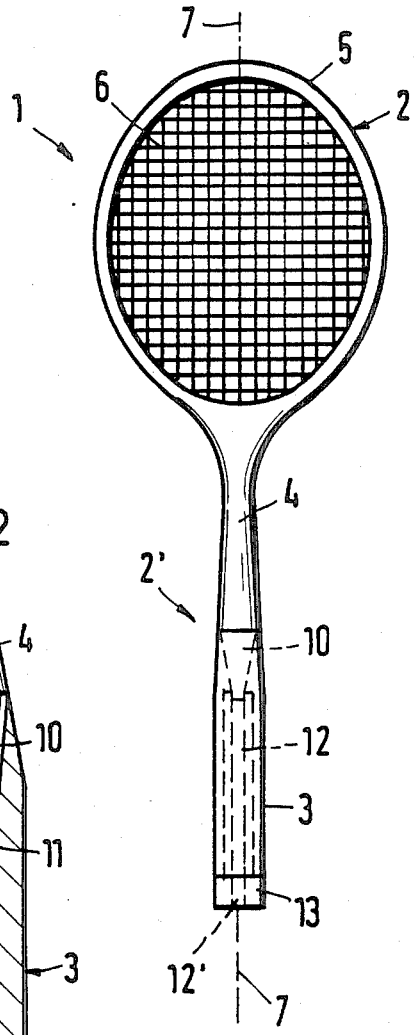
FIG. 1 is a view of a tennis racket with a steplessly adjustable grip secured to the handle bar in accordance with the invention.

FIG. 1 shows a tennis racket 1 embodying the teachings of the invention and comprising a frame 2 merging into a handle bar 2'. The frame 2 surrounds a racket head 5 with its strings 6. A grip 3 is adjustably secured to the handle bar 2' so that the grip may be twisted in relation to the racket head 5 about the longitudinal axis 7 of the racket steplessly and locked in every setting. With respect to the angular setting of the grip relative to the plane defined by the head 5 and with respect to taking up turning or torsional forces between the grip 3 and the handle bar 2' the connecting elements joining the handle 3 to the handle bar 2' of the racket are of the force locking or frictional kind. The axial connection on the other hand is form locking.

For this purpose the handle bar 2' has three sections, namely a shank 4 merging into the frame 2, a conical member 10, and a bolt 12 having a male threading 12' at least near its free outer end. The conical member 10 may be relatively short and provides a transition between the shank 4 and the bolt 12. Thus, the thick end of the conical member is integrated into the shank 4 and the thin end is connected into the bolt 12 to form a male conical surface 8 for cooperation with a respective female conical surface 9 of a conical recess 11 as best seen in FIG. 2.

The conical member 10 is pulled into the conical recess 11 by rotating a nut-type member 13 with a female threading 14 on the male threading 12' in the tightening direction.

The grip 3 is a sleeve-like or tubular element provided with the female conical recess 11 at the shank facing end for receiving the conical member 10. The grip 3 also has a cylindrical bore 15 through which the bolt 12 extends for cooperation with the nut type member 13 screwing onto the threaded end 12' of the bolt 12 like a nut. When the nut 13 is loosened, it is possible to rotate the grip 3 relative to the handle bar 2' into the desired position. Tightening of the nut 13 establishes a fixed, force locking relationship between the grip 3 and the handle bar 2' without any slip clutch effect.

Figure 2:
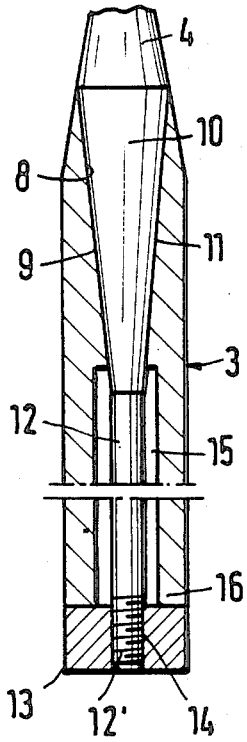
FIG. 2 is an axial section through the grip and through part of the shank, on a larger scale than FIG. 1.
Figure 3:
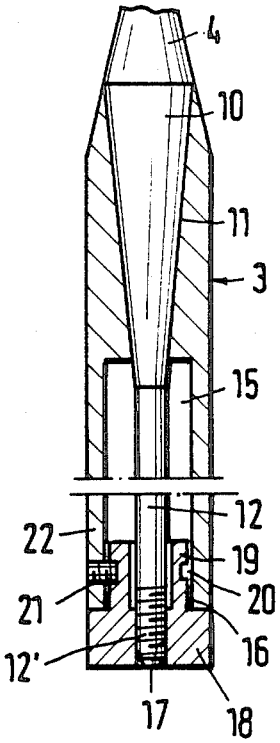
FIG. 3 is a section, similar to FIG. 2 through a modified embodiment of the invention.

In the forms of the invention shown in FIGS. 1, 2, and 3 the nut 13 is so shaped that it can form part of the grip end 16 and acts on the shoulder formed by the end 16 in the direction of the longitudinal axis 7 for pulling the conical member 10 into the conical recess 11. The nut 13 has a rough outer face to facilitate its rotation by hand.

FIG. 3 shows a modified form of the invention in which the nut type member 18 also forms part of the grip end 16 and also has a sleeve extension 19 within the bore 15 in the grip 3. The sleeve extension 19 has a radially outwardly open ring groove 20 cooperating with at least one retaining element 21, such as a set screw screwed radially through the wall 22 of the grip 3. The inner end of the set screw 21 can slide in the groove 20. The nut 18 has a female screw thread 17 for the threaded end 12' of the bolt 12. For pulling the conical member 10 into the conical recess 11 the nut 18 is tightened, thereby bearing against the end 16 of the grip 3. On the other hand, the grip 3 may also be separated from the conical member 10 by loosening the nut 18, whereby the nut bears against the set screw 21. The shank 4, the conical member 10 and the bolt 12 or cylindrical section form an integral, one-piece handle bar.

Figure 4:
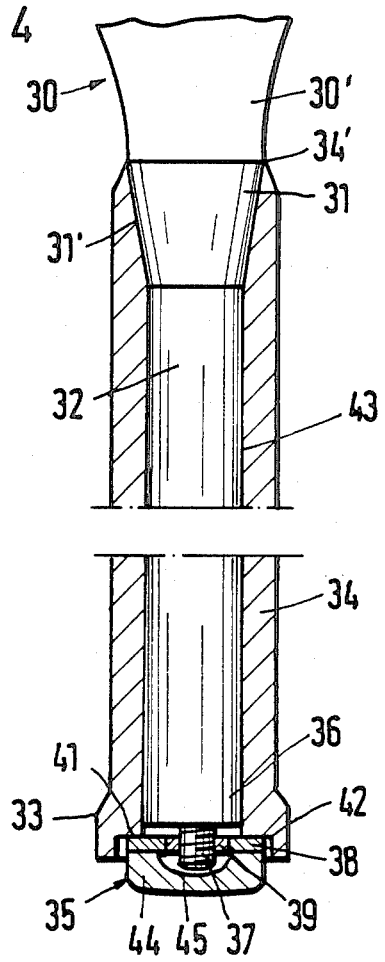
FIG. 4 is an axial sectional view through the grip construction of a third embodiment of the invention.

In FIG. 4 the racket 30 has a shank 30' provided with a conical section 31 merging into a cylindrical section 32 of substantial diameter relative to the outer diameter of the grip 34 provided with a cylindrical bore 43 having an inner diameter such that a tight frictional sliding fit is assured between the cylindrical section 32 and the bore 43 when a special nut 35 is still loose. The conical section 31 is axially short relative to the length of the grip 34 and the radial dimension of the conical section 31 relative to the radial dimension of the conical recess 31' is such that a frictional sliding fit is also assured between the conical section 31 and the conical recess 31' when the special nut 35 is not yet tightened on a threaded stud 37 extending axially from the end of the cylindrical section 36. The combined axial length of the conical section 31 and of the cylindrical section 32 is shorter than the axial length of the grip 34 between its racket facing end 34' and its shoulder 41 at its free end 33. Thus, tightening the nut 35 pulls the handle bar into the grip 34 for a force locking fit.

The shoulder 41 in the free end 33 of the grip 34 is surrounded by a recess 42 sized to freely receive the nut 35 having a disk 38 with a threaded hole 39 for cooperation with the threaded stud 37. A wing 44 with a recess 45 is secured to the disk 38 for turning the nut 35 in the tightening direction or in the loosening direction. The recess 45 is so dimensioned that the threaded stud can freely reach into the recess 45 even if the nut 35 is fully tightened.

Figure 5:
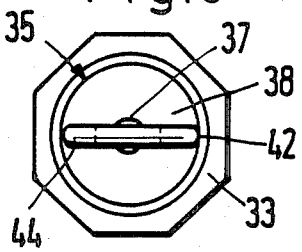
FIG. 5 is a view in the axial direction toward the end surface of the grip of FIG. 4.

FIG. 5 shows that the free end 33 of the grip 34 may, for example, have an octagonal configuration, while the recess 42 in this free end 33 is circular. The force fit between the grip 34 and the sections 31, 32 of the handle bar may be loosened by loosening the nut 35 slightly and then pushing the wing 44 against a stationary surface.

Figure 6:
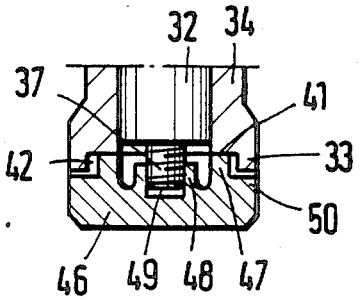
FIG. 6 is an axial sectional view through a modified threaded member for tightening the threaded bolt relative to the grip end.

FIG. 6 shows a modified nut 46 shaped to conform to the free end 33, for example having an octagonal configuration, of the grip 34. The nut 46 has an inwardly reaching circular ring shoulder 47 for cooperation with the shoulder 41 in the recess 42 of the grip end 33. The axial length of the ring shoulder 47 is such that tightening the nut 46 will pull the handle bar into the required frictional force fit with the grip 34. When the nut 46 is completely tightened its outer shoulder 50 barely touches the free end 33 of the grip 34. The nut 46 further has an axially extending central stud 48 with a central threaded recess 49 for cooperation with the threaded stud 37 of the cylindrical section 32 of the handle bar. The frictional force fit is loosened by loosening the nut 46 slightly and then pushing the nut 46 against a fixed surface.

Due to the relatively large diameter of the conical section 31 and of the cylindrical section 32 a large area frictional surface contact is assured between the sections 31, 32 and the respective inner surfaces of the recess 31' and the bore 43, whereby the desired force fit without a slip clutch effect is assured.

As shown, the diameter of the threaded stud 37 is noticeably smaller than the diameter of the cylindrical section 32 for assuring the desired pulling effect of the nuts 35 or 46 against the shoulder 41. However, by constructing the nut 35 or 46 respectively, it is possible to provide the required threading directly in the cylindrical surface of the section 32 near its free end.

It is critical that the conicity of the section 31 is slight and that the length of the conical section is relatively short so that the resulting force fit is releasable again by the above described relatively light pushing of the loosened nut in the axial direction. A sharp long cone may require substantial axial impacts for loosening the force fit which is undesirable. Thus, the invention achieves a force fit which is just large enough to avoid a slip clutch effect, but also too small to result in a substantially permanent connection of the grip to the handle bar, which can be loosened only with substantial axial impacts.

The present racket is preferably made of fiber reinforced synthetic resins, whereby different types of resins and fibers may be used for different parts of the racket. Especially the inwardly facing surfaces 8 or 31', 43 of the grip 3 or 34 and the outwardly facing surfaces of the conical members 10 or 31 and of the cylindrical section 32 will be made of fiber reinforced synthetic resins having the required friction coefficient.

Although the invention has been described with reference to specific example embodiments, it will be appreciated, that it is intended to cover all modifications and equivalents within the scope of the appended claims.

What I claim is:

1. A racket for ball games, comprising a frame defining a racket head, a handle bar extending from said racket head, a hollow grip for attachment to a portion of said handle bar, said handle bar comprising a shank portion having one end attached to said racket head, a male conical section having one end attached to the end of said shank portion, and a cylindrical section having one end attached to the other end of said male conical section, said male conical section having a large diameter merging into said shank and a small diameter merging into said cylindrical section of said handle bar, said cylindrical section of said handle bar having first threaded means at its end opposite said conical section, and a connecting means further including as part of said hollow grip a female conical recess at a grip end facing said shank for receiving said male conical section of said handle bar, said hollow grip further comprising a cylindrical bore merging into said female conical recess and extending entirely through said hollow grip for receiving said cylindrical section of said handle bar, and second threaded means for cooperation with said first threaded means of said cylindrical section, said second threaded means having a flange bearing against a shoulder of said hollow grip for pulling said conical section into said conical recess to provide an exclusively frictional force locking rigid connection between said hollow grip and said handle bar in a rotational direction about a longitudinal central axis of said handle bar when said first and second threaded means are tightened to each other, said conical section and said conical recess are axially short relative to the length of said hollow grip and wherein said large diameter is slightly larger than said small diameter to provide a conicity which on the one hand assures said exclusively frictional force locking rigid connection while on the other hand being sufficiently slight and short enough for permitting a continuous stepless rotational adjustment of said racket head relative to said hollow grip into any relative angular position between said racket head and said hollow grip when said first and second threaded means are loosened for releasing said frictional force locking.

2. The racket of claim 1, wherein said first threaded means comprise a male threaded portion on said opposite end of said cylindrical section of said handle bar, and wherein said second threaded means comprise a nut having a female threading for cooperation with said male threaded portion, said nut having a configuration forming part of said hollow grip at its free grip end.

3. The racket of claim 2, wherein said nut comprises a cylindrical sleeve reaching into said cylindrical bore of said hollow grip, said cylindrical sleeve having a radially outwardly open ring groove therein, and set screw means reaching through said hollow grip radially into said ring groove for locking said nut in a tightened position.

4. The racket of claim 1, wherein said cylindrical section of said handle bar has a substantial outer diameter corresponding to an inner diameter of said cylindrical bore for an optimal frictional surface contact between said cylindrical section and said cylindrical bore to enhance said frictional force locking connection when said first and second threaded means are tightened and to provide a tight sliding fit when said first and second threaded means are loosened.

5. The racket of claim 1, wherein said hollow grip has a given grip length, wherein said male conical section has an axial length within the range of about 5 percent to about 30 percent of said given grip length, and wherein said large diameter is within the range of about 1.01 to about 1.25 of said small diameter to provide, depending on the axial length of said male conical section, a relatively small conicity for said male conical section to avoid a permanent force locking between the hollow grip and the handle bar.

6. The racket of claim 1, wherein said second threaded means comprise a disk with a threaded bore for cooperation with said first threaded means, and a wing secured to said disk substantially at a right angle relative to said disk, said wing having a recess above said threaded bore for providing a space for said first threaded means extending through said threaded bore.

7. The racket of claim 1, wherein said second threaded means comprise a nut having a ring shoulder for cooperation with a respective shoulder in a free end of said hollow grip, said nut having an external configuration corresponding to that of said hollow grip so that said nut becomes part of said hollow grip, said nut having a central female threading for cooperation with said first threaded means to pull said handle bar into said hollow grip and into a frictional force fit between said hollow grip and said handle bar relative to torque loads when said nut is tightened.

* * * * *